US011445817B2

(12) United States Patent
Ergun et al.

(10) Patent No.: US 11,445,817 B2
(45) Date of Patent: Sep. 20, 2022

(54) WORKSTATION HEIGHT-ADJUSTMENT MONITORING

(71) Applicant: Ergotron, Inc., St. Paul, MN (US)

(72) Inventors: Mustafa Ergun, Eden Prairie, MN (US); Shaun Christopher Lindblad, Inver Grove Heights, MN (US); William Dale Tischer, Shoreview, MN (US); Jeffrey Aymond, Inver Grove Heights, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 17/438,846

(22) PCT Filed: Sep. 11, 2020

(86) PCT No.: PCT/US2020/050435

§ 371 (c)(1),
(2) Date: Sep. 13, 2021

(87) PCT Pub. No.: WO2021/050897

PCT Pub. Date: Mar. 18, 2021

(65) Prior Publication Data

US 2022/0202178 A1 Jun. 30, 2022

Related U.S. Application Data

(60) Provisional application No. 62/900,083, filed on Sep. 13, 2019.

(51) Int. Cl.
*A47B 21/02* (2006.01)
*A47B 9/02* (2006.01)
(Continued)

(52) U.S. Cl.
CPC ..... *A47B 21/02* (2013.01); *A47B 9/02* (2013.01); *A47B 9/12* (2013.01); *A47B 9/16* (2013.01); *A47B 2200/0062* (2013.01)

(58) Field of Classification Search
CPC .... A47B 21/02; A47B 9/16; A47B 2200/0062
See application file for complete search history.

(56) References Cited

U.S. PATENT DOCUMENTS 5,299,488 A 4/1994 Kadlicko et al.
5,305,238 A 4/1994 Starr, III et al.
(Continued)

FOREIGN PATENT DOCUMENTS

CN 202286910 U 7/2012
DE 112020004349 T5 5/2022
(Continued)

OTHER PUBLICATIONS

"International Application Serial No. PCT/US2020/050435, International Search Report dated Dec. 3, 2020", 2 pgs.
(Continued)

*Primary Examiner* — Eman A Alkafawi
(74) *Attorney, Agent, or Firm* — Schwegman Lundberg & Woessner, P.A.

(57) ABSTRACT

A workstation including a height-adjustable work surface is described. The workstation includes a frame, and the work surface is configured to translate relative to the frame to vary a height of the work surface. A lift assembly configured to assist translation of the work surface relative to the frame. The lift assembly includes a moveable component and translation of the moveable component results in a translation of the work surface relative to the frame. A translation sensor is coupled to one of the frame or the movable component, and it is configured to measure translation of the moveable component relative to the frame. A control circuit is in communication with the translation sensor to determine an amount of translation of the work surface relative to the frame.

11 Claims, 9 Drawing Sheets

(51) Int. Cl.

| | |
|---|---|
| ***A47B 9/16*** | (2006.01) |
| ***A47B 9/12*** | (2006.01) |

(56) References Cited

U.S. PATENT DOCUMENTS

| | | | |
|---|---|---|---|
| 5,323,695 | A | 6/1994 | Borgman et al. |
| 6,075,755 | A | 6/2000 | Zarchan |
| 6,312,363 | B1 | 11/2001 | Watterson et al. |
| 6,580,360 | B1 | 6/2003 | Mckee et al. |
| 6,948,136 | B2 | 9/2005 | Trewin |
| 7,161,490 | B2 | 1/2007 | Huiban |
| 7,301,463 | B1 | 11/2007 | Paterno |
| 7,439,956 | B1 | 10/2008 | Albouyeh et al. |
| 8,024,202 | B2 | 9/2011 | Carroll et al. |
| 8,109,858 | B2 | 2/2012 | Redmann |
| 8,139,034 | B2 | 3/2012 | Albouyeh et al. |
| 8,550,820 | B2 | 10/2013 | Soltanoff |
| 8,688,467 | B2 | 4/2014 | Harrison et al. |
| 8,743,198 | B2 | 6/2014 | Padmanabh et al. |
| 8,935,985 | B2 | 1/2015 | Hjelm |
| 8,947,215 | B2 | 2/2015 | Mandel et al. |
| 8,965,541 | B2 | 2/2015 | Martinez et al. |
| 8,991,320 | B2 | 3/2015 | Desroches et al. |
| 9,039,016 | B2 | 5/2015 | Abernethy et al. |
| 9,044,172 | B2 | 6/2015 | Baxi et al. |
| 9,128,521 | B2 | 9/2015 | Chang et al. |
| 9,167,894 | B2 | 10/2015 | Desroches et al. |
| 9,196,175 | B2 | 11/2015 | Walsh et al. |
| 9,412,262 | B2 | 8/2016 | Baker et al. |
| 9,486,070 | B2 | 11/2016 | Labrosse et al. |
| 9,514,637 | B2 | 12/2016 | Baker et al. |
| 9,717,950 | B2 | 8/2017 | Sigal et al. |
| 9,775,431 | B2 | 10/2017 | Abernethy et al. |
| 9,844,344 | B2 | 12/2017 | Horseman |
| 9,907,396 | B1 | 3/2018 | Labrosse et al. |
| 9,916,537 | B2 | 3/2018 | Ruiz et al. |
| 9,921,726 | B1 | 3/2018 | Sculley et al. |
| 9,955,780 | B2 | 5/2018 | Koch |
| 9,969,216 | B2 | 5/2018 | Sigal et al. |
| 9,971,340 | B1 | 5/2018 | Labrosse et al. |
| 9,993,068 | B2 | 6/2018 | Lin et al. |
| 9,999,971 | B2 | 6/2018 | Charlton et al. |
| 10,021,530 | B2 | 7/2018 | Sigal et al. |
| 10,038,952 | B2 | 7/2018 | Labrosse et al. |
| 10,085,562 | B1 | 10/2018 | Labrosse et al. |
| 10,092,092 | B2 | 10/2018 | Koch |
| 10,114,352 | B2 | 10/2018 | Matlin |
| 10,123,613 | B2 | 11/2018 | Hall et al. |
| 10,126,720 | B2 | 11/2018 | Liu |
| 10,126,731 | B2 | 11/2018 | Lindström |
| 10,130,168 | B2 | 11/2018 | Lee et al. |
| 10,130,169 | B1 | 11/2018 | Labrosse et al. |
| 10,130,170 | B1 | 11/2018 | Labrosse et al. |
| 10,133,261 | B2 | 11/2018 | Labrosse et al. |
| 10,154,736 | B2 | 12/2018 | Lin et al. |
| 10,159,337 | B2 | 12/2018 | Abernethy et al. |
| 10,206,498 | B1 | 2/2019 | Labrosse et al. |
| 10,209,705 | B1 | 2/2019 | Labrosse et al. |
| 10,453,572 | B1 * | 10/2019 | Brooks ..... G16H 40/40 |
| 2004/0010328 | A1 | 1/2004 | Carson et al. |
| 2006/0205564 | A1 | 9/2006 | Peterson |
| 2007/0219059 | A1 | 9/2007 | Schwartz et al. |
| 2008/0245279 | A1 | 10/2008 | Pan |
| 2008/0255794 | A1 | 10/2008 | Levine |
| 2009/0273441 | A1 | 11/2009 | Mukherjee |
| 2010/0198374 | A1 | 8/2010 | Carson et al. |
| 2011/0033830 | A1 | 2/2011 | Cherian |
| 2013/0199420 | A1 | 8/2013 | Hjelm |
| 2013/0204438 | A1 | 8/2013 | Hjelm |
| 2013/0331993 | A1 | 12/2013 | Detsch et al. |
| 2014/0302795 | A1 | 10/2014 | Chacon et al. |
| 2015/0120238 | A1 | 4/2015 | Marvit et al. |
| 2016/0113389 | A1 | 4/2016 | Desroches et al. |
| 2016/0127809 | A1 | 5/2016 | Sigal et al. |
| 2016/0128467 | A1 | 5/2016 | Sigal et al. |
| 2016/0231731 | A1 | 8/2016 | Carver et al. |
| 2016/0301992 | A1 | 10/2016 | Barch et al. |
| 2016/0353880 | A1 | 12/2016 | Sigal et al. |
| 2017/0042322 | A1 | 2/2017 | Labrosse et al. |
| 2017/0052517 | A1 | 2/2017 | Tsai et al. |
| 2017/0054734 | A1 | 2/2017 | Sigal et al. |
| 2017/0135587 | A1 | 5/2017 | Desroches |
| 2018/0005386 | A1 | 1/2018 | Thangappan et al. |
| 2018/0137645 | A1 | 5/2018 | Danne |
| 2018/0279770 | A1 | 10/2018 | Crowe et al. |
| 2018/0289175 | A1 | 10/2018 | Lukas |
| 2019/0025781 | A1 | 1/2019 | Matlin |
| 2021/0267707 | A1 * | 9/2021 | Sung ..... A61G 12/00 |

FOREIGN PATENT DOCUMENTS

| | | | |
|---|---|---|---|
| JP | 2016087031 | A | 5/2016 |
| TW | 201216895 | A | 5/2011 |
| TW | I634456 | B | 9/2018 |
| WO | WO-2016139293 | A1 | 9/2016 |
| WO | WO-2018210387 | A1 | 11/2018 |
| WO | WO-2018223240 | A1 | 12/2018 |
| WO | WO-2018231824 | A1 | 12/2018 |
| WO | WO-2018231828 | A1 | 12/2018 |
| WO | WO-2019169191 | A1 | 9/2019 |
| WO | WO-2021050897 | A1 | 3/2021 |

OTHER PUBLICATIONS

"International Application Serial No. PCT/US2020/050435, Written Opinion dated Dec. 3, 2020", 4 pgs.

"International Application Serial No. PCT/US2020/050435, Response to Written Opinion filed Jul. 13, 2021 to Written Opinion dated Dec. 3, 2020", 10 pgs.

"International Application Serial No. PCT/US2020/050435, International Preliminary Report on Patentability dated Sep. 23, 2021", 5 pgs.

* cited by examiner

WORKSTATION HEIGHT-ADJUSTMENT MONITORING

CLAIM OF PRIORITY

This patent application is a U.S. National Stage of PCT Application Serial No. PCT/US2020/050435, titled "WORKSTATION HEIGHT-ADJUSTMENT MONITORING," filed on Sep. 11, 2020, and published as WO 2021/050897 A1, on Mar. 18, 2021, which claims the benefit of priority of Ergun, et al. U.S. Provisional Patent Application Ser. No. 62/900,083, titled "WORKSTATION HEIGHT-ADJUSTMENT MONITORING," filed on Sep. 13, 2019, which are hereby incorporated by reference herein in their entirety.

TECHNICAL FIELD

This document pertains generally, but not by way of limitation, to workstations, for instance a computer cart, a desk, or the like.

BACKGROUND

A workstation can include a frame and a work surface. In some examples, the work surface can move relative to the frame. For instance, a user can operate a lock assembly to allow the user to adjust the orientation of the work surface (e.g., change a height) with respect to the frame to accommodate users varying postures during the use of the workstation.

BRIEF DESCRIPTION OF THE DRAWINGS

The following drawings are illustrative of particular non-limiting example configurations of the present invention and therefore do not limit the scope of the invention. The drawings are not to scale and are intended for use in conjunction with the explanations in the following detailed description. Example configurations of the present invention will hereinafter be described in conjunction with the appended drawings. The drawings illustrate generally, by way of example, but not by way of limitation, various configurations discussed in the present document.

OVERVIEW

This disclosure is directed to a workstation including a height-adjustable work surface and a frame. The work surface can be configured to translate relative to the frame, for instance to vary a height of the work surface. More particularly, the workstation can include a translation sensor providing a user with information related to the operation of the work surface (e.g., location of the worksurface relative to the frame).

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
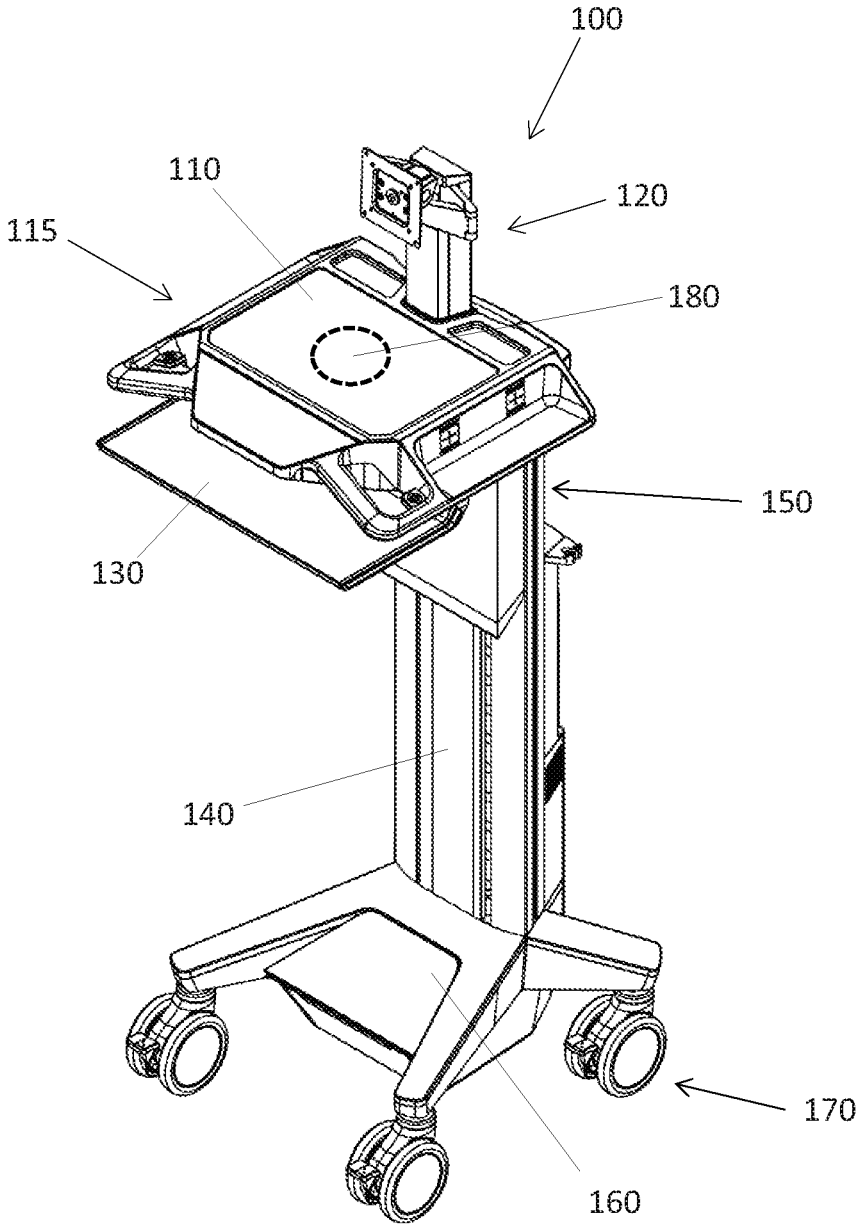
FIG. 1 illustrates a perspective view of an example workstation, according to an example configuration of the present subject matter.

FIG. 1 illustrates a perspective view of an example of a workstation 100, according to an example configuration of the present subject matter. The workstation 100 can include a work surface 110. For example, the work surface 110 can be included in a head unit 115. A display riser 120 can be included in the workstation 100. For instance, a display (e.g., LED screen, or the like) can be coupled to the display riser 120.

The workstation 100 can include a frame 140 (e.g., a riser, a support column, pedestal, foot, or the like), and the work surface 110 can translate with respect to the frame 140. For example, a moveable bracket 150 can be moveably coupled to the frame 140, and the head unit 115 can be coupled to the moveable bracket 150. The moveable bracket 150 can translate with respect to the frame 140, and the head unit 115 can translate with respect to the frame 140. Accordingly, the work surface 110 can translate with respect to the frame 140.

In some examples, the workstation 100 can include a base 160. The base 160 can support the frame 140 (and the work surface 110). The base 160 can include a wheel assembly 170, and the wheel assembly 170 can allow for the workstation 100 to move along a surface (e.g., a floor, the ground, or the like).

As discussed in greater detail herein, the workstation 100 can include a control circuit 180. The control circuit 180 can monitor the location of the work surface 110 relative to (e.g., with respect to) the frame 140.

Figure 2:
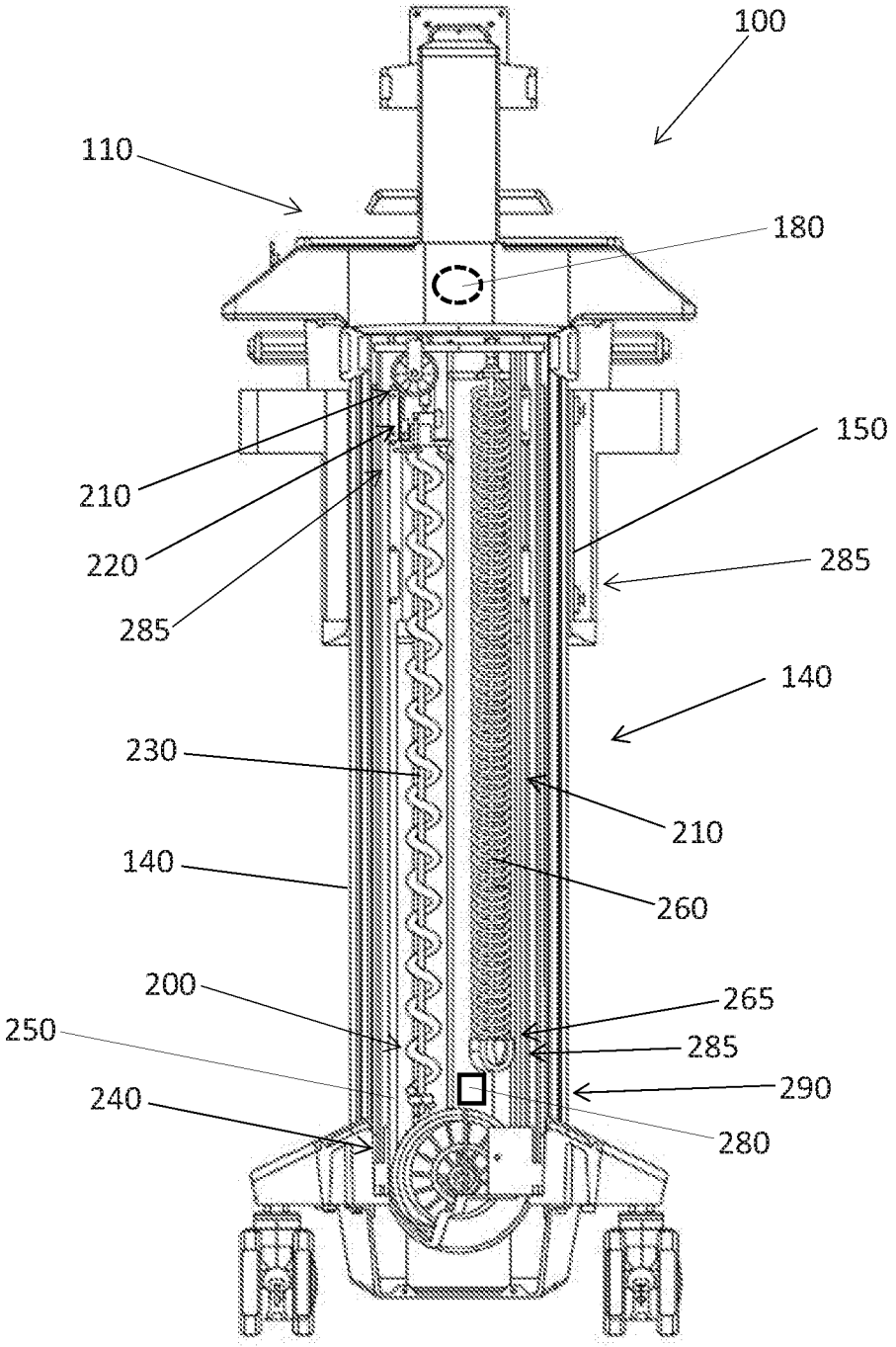
FIG. 2 illustrates a rear view of the workstation of FIG. 1, according to an example configuration of the present subject matter.

FIG. 2 illustrates a rear view of the workstation 100 of FIG. 1, according to an example configuration of the present subject matter. Portions of the workstation (e.g., a wall, panel, or the like) have been hidden for clarity. The workstation 100 can include a lift assembly 200. The lift assembly 200 can assist (e.g., facilitate, help, or the like) the translation of the work surface 110 relative to frame 140. For example, the lift assembly 200 can include one or more moveable components 210, and the moveable components 210 can cooperate to assist the translation of the work surface 110 relative to the frame 140.

For instance, a brake assembly 220 can selectively translate with respect to a lock rod 230. The lock rod 230 can be coupled to the frame 140, and the brake assembly 220 can be sized and shaped to receive the lock rod 230. The brake assembly 220 can engage with (e.g., grip, squeeze, grab, or the like) the lock rod 230 to maintain (e.g., hold, lock, secure, fasten, or the like) the location of the work surface 110 with respect to the frame 140. The brake assembly 220 can be coupled to one or more of the work surface 110, the head unit 115, and the moving bracket 150.

The lift assembly 200 can include a wheel assembly 240, and the wheel assembly 240 can rotate during adjustment of the location of the work surface 110. For example, the wheel assembly 240 can be a pulley, and a tension member 250 (e.g., a cable, or the like) can engage with the wheel assembly 240. Translation of the work surface 110 can translate the tension member 250 and the wheel assembly 240. The tension member 250 can be coupled to a biasing member 260 (e.g., a spring, or the like), for instance, coupled to an end 265 of the biasing member. The biasing member 260 can translate (e.g., stretch, expand, retract, compress, or the like) when the work surface 110 translates relative to the frame 140. Accordingly, the wheel assembly 240, the tension member 250, and the biasing member 260 can be included in the moveable components 210.

In an example, the workstation 100 can be similar to (and can incorporate components of) the height adjustable platform described in commonly assigned U.S. patent application Ser. No. 16/290,766 entitled "HEIGHT ADJUSTABLE PLATFORMS AND ASSOCIATED MECHANISMS," filed on Mar. 1, 2019, which is hereby incorporated by reference herein in its entirety. For instance, the workstation 100 (e.g., the lift assembly 200) can include a counterbalance mechanism, a lock rod, a chassis, a brake assembly, or the like.

In some examples, the workstation 100 can include at least one translation sensor 280. The translation sensor 280 can measure translation of one or more of the moveable components 210 relative to a reference point 290. For example, the sensor 280 can be coupled to the frame 140. In some examples, the sensor 280 can be coupled to the moveable components 210.

A sensor operator 285 (e.g., the end 265 of the biasing member 260) can be coupled to (or included in) the moveable components 210. The translation sensor 280 can detect the sensor operator 285, and the translation sensor 280 can determine the location of (or the change in location of) the sensor operator 285 relative to the sensor 280 (e.g., the sensor 280 can detect the translation of the biasing member 260, the brake assembly 220, or the like). For instance, the sensor 280 can include a hall effect sensor, and the sensor operator 285 can include a magnet. The sensor 280 can detect a change in a magnetic field, for instance when the moveable component 210 is translated. The sensor 280 can modulate an electrical property (e.g., voltage, current, impedance, or the like) when the sensor operator 285 translates relative to the sensor 280. Accordingly, the sensor 280 can measure the translation of the moveable components 210 relative to the reference point 290.

The sensor 280 (and the sensor operator 285) can include (but is not limited to) one or more of an optical sensor, a potentiometer, an accelerometer, a hall effect sensor, and a transducer. The sensor 280 can be in communication with the control circuit 180 (shown in FIG. 1), and the sensor operator 285 can be in communication with the control circuit 180. For instance, the sensor 280 can communicate with a wireless connection (e.g., by transmitting and receiving electromagnetic waves), or through a wired connection. Accordingly, the control circuit 180 can determine the location of the work surface 110 (or other components of the workstation 100) with respect to the frame 140 by communicating with the translation sensor 280 that measures the translation of the moveable components 210.

One of either the sensor 280 or the sensor operator 285 can be attached to the frame 140 (fixed component), and the other one of the sensor 280 or the sensor operator 285 can be attached to the moveable components 210. The sensor 280 and the sensor operator 285 can be interchanged on components of the workstation 100, and can result in the same cycle count or height measurement.

Figure 3:
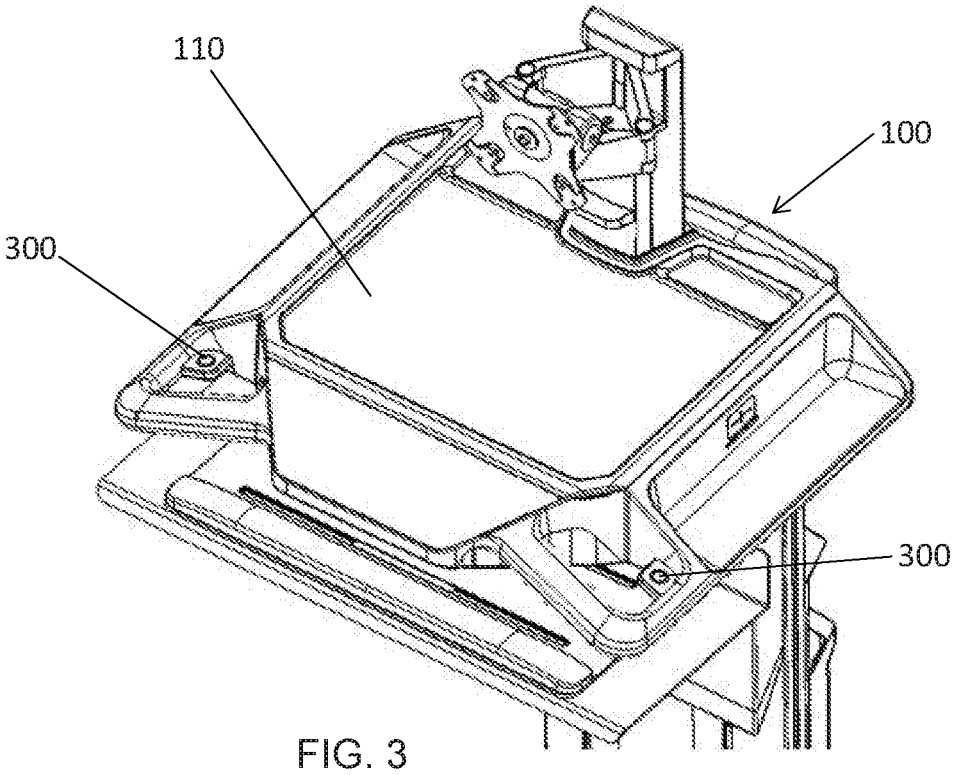
FIG. 3 illustrates another perspective view of the workstation of FIG. 1, according to an example configuration of the present subject matter.

FIG. 3 illustrates another perspective view of the workstation 100 of FIG. 1, according to an example configuration of the present subject matter. The workstation 100 can include at least one of an activation switch 300. The switch 300 can facilitate the adjustment of the location of the work surface 110. For instance, the switch 300 can facilitate the selective engagement of the brake assembly 220 with the lock rod 230. A user can engage with (e.g., push, pull, twist, or the like) the switch 300 to disengage (e.g., release, or the like) the brake assembly 220 from the lock rod 230. Disengaging the brake assembly 220 from the lock rod 230 can allow the work surface 110 to translate with respect to the frame 140.

Figure 4:
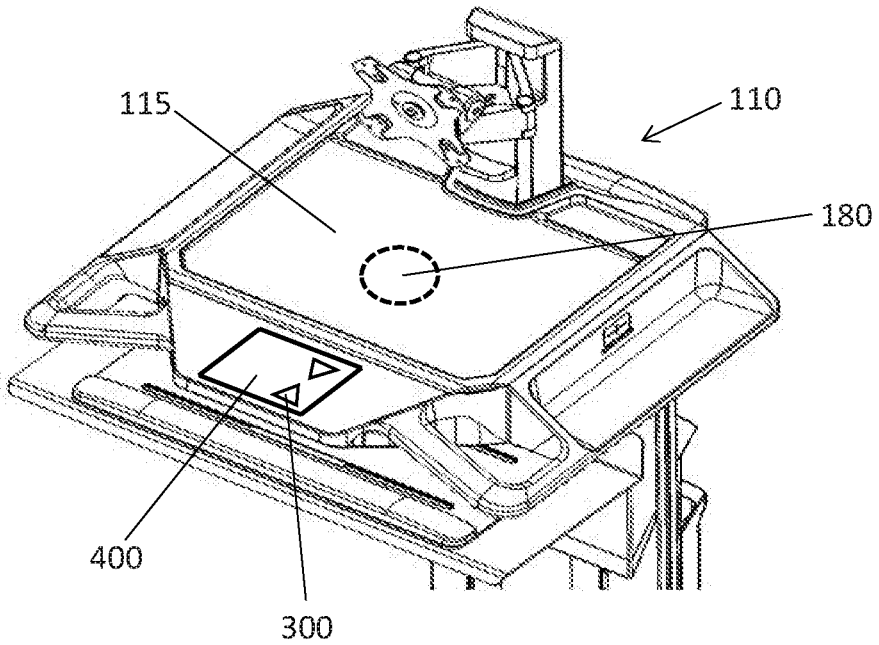
FIG. 4 illustrates yet another perspective view of the workstation of FIG. 1, according to an example configuration of the present subject matter.

FIG. 4 illustrates yet another perspective view of the workstation 100 of FIG. 1, according to an example configuration of the present subject matter. In some examples, the workstation 100 can include a display 400 (e.g., an LED screen, a touchscreen, or the like). The activation switch 300 can be presented on the display 400, and a user may engage with the activation switch 300 on the display 400 to adjust the location of the work surface 100. The control circuit 180 can be in communication with the display 400, and the control circuit 180 can transmit one or more signals to the display 400 to cause the display to present information (e.g., operating instructions, safety notifications, time, battery life, or the like) or graphical interface objects (e.g., the activation switch 300, or the like).

As described herein, the activation switch 300 can facilitate the adjustment of the location of the work surface 110. Operation of the activation switch 300 can be monitored, for instance to determine the amount of displacement and direction of displacement of the work surface 110, and to calculate the height adjustment cycle count.

For example, the speed of linear actuators (e.g., the actuator 500, shown in FIG. 5) can vary in a known range, for example from 1.3 in/sec to 2 in/sec. Accordingly, the total travel of any component that is connected to the linear actuator (for example the moving bracket 150 of FIG. 2) can be determined for a selected time period. In an example, a user can manipulate the switch 300 to activate the linear actuator, and the duration of a height adjustment can be determined from pressing and releasing of the switch 300. The control circuit 180 can be in communication with the switch 300, and the control circuit 180 can determine the amount of time that the switch 300 was operated. For instance, operation of the switch 300 can transmit a signal to the control circuit 180. The control circuit 180 can start a timer when the switch 300 is operated, and the control circuit 180 can stop the timer when the user stops operating the switch 300. The control circuit 180 can use the timer duration to determine the displacement of the linear actuator (or the work surface 110) because the speed of the linear actuator is known. For example, the amount of displacement of the linear actuator can be determined using the timer duration that the linear actuator was operated with the switch 300 and the average speed of the linear actuator when operated.

Figure 5:
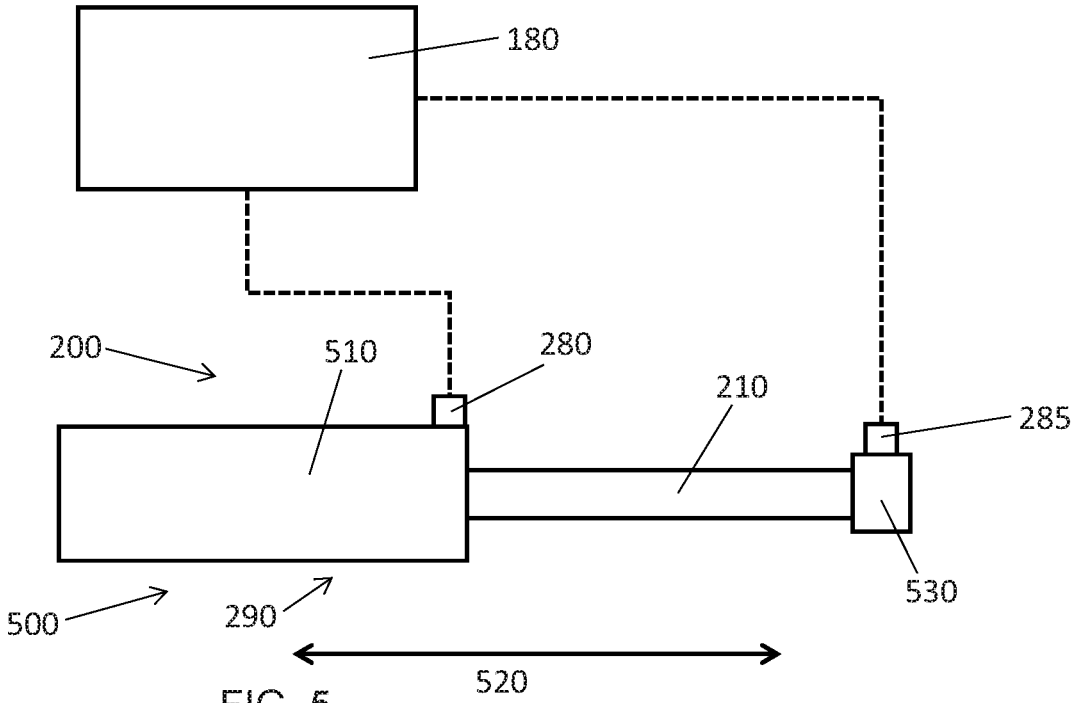
FIG. 5 illustrates a schematic view of another example of the workstation, according to an example configuration of the present subject matter.

FIG. 5 illustrates a schematic view of another example of the workstation 100, according to an example configuration of the present subject matter. The lift system 200 can include an actuator 500 (e.g., a hydraulic cylinder, or the like). The actuator 500 can include a housing 510, and the housing 510 can include the reference point 290. The actuator 500 can include the moveable component 210 (e.g., a piston). The moveable component 210 can translate with respect to the housing 510, for example along an axis 520. The sensor 280 can be coupled to the actuator 500, for instance the sensor 280 can be coupled to the housing 510. The sensor operator 285 can be coupled to the actuator 500, for instance the sensor operator 285 can be coupled to an end 530 of the moveable component 210. The sensor 280 and the sensor operator 285 can be in communication with the control circuit 180, and the control circuit 180 can determine the location of the work surface 110 (shown in FIG. 1) based on the measurements by the sensor 280 and the sensor operator 285.

For example, translation of the moveable components 210 can be detected by the sensor 280, and the control circuit 180 can determine the change in location of the moveable components 210 using measured acceleration of the moveable components 210. The control circuit 180 can determine a representation of the work surface displacement based on the measured translation of the moveable component 210 relative to the reference point 290. In some examples, acceleration of the moveable components 210 can be continuously monitored by the control circuit 180. The control circuit 180 can continuously update the representation of the work surface displacement based on the continuously monitored acceleration of the moveable components 210.

In an example, the workstation 100 can be similar to (and can incorporate components of) the height adjustable platform described in commonly assigned PCT Patent Application Ser. No. PCT/US2019/020136 entitled "SENSOR BASED ENHANCED CUSTOMER EXPERIENCE," filed on Feb. 28, 2019, which is hereby incorporated by reference herein in its entirety. For instance, the workstation 100 can include a system for electronic telemetry-based device monitoring, sensors, a sensor controller, an input/output controller, or the like.

Figure 6:
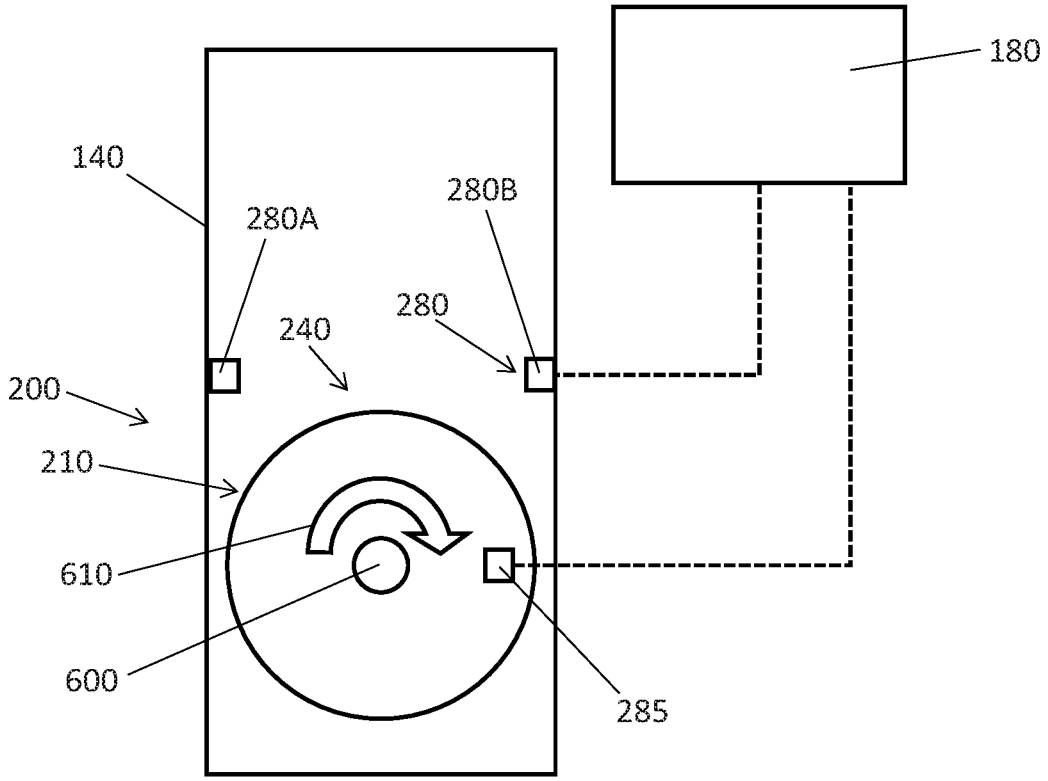
FIG. 6 illustrates a schematic view of yet another example of the workstation, according to an example configuration of the present subject matter.

FIG. 6 illustrates a schematic view of yet another example of the workstation 100, according to an example configuration of the present subject matter. As described herein, the lift assembly 200 can include the wheel assembly 240. The wheel assembly 240 can rotate, for instance about a pivot point 600 and in a first direction 610 (e.g., in clockwise direction).

The control circuit 180 can determine the amount that the wheel assembly 240 rotates, for instance with the sensor 280 and the sensor operator 285. In some examples, the workstation 100 can include one or more of the sensor 280, for example two sensors 280 can be coupled to the frame 140. The sensors 280 can measure the change in location of the sensor operator 285 (e.g., by detecting a change in a magnetic field as the wheel assembly 240 rotates). The sensors 280 can help determine what direction the wheel assembly 240 is rotating (e.g., in the first direction 610). For instance, the sensors 280 can include a first sensor 280A and a second sensor 280B. The sensors 280 can detect the sensor operator 285 and when the wheel assembly 240 rotates, the sensor operator 285 can interact with the sensor 280A and then the sensor 280B. Accordingly, the control circuit 180 can determine that the wheel assembly 240 is rotating in the first direction 610. In some examples, the control circuit 180 can determine the location of the work surface 110 (shown in FIG. 1) based on the sensor 180 measuring linear, or non-linear, motion of the moveable components 210

Figure 7A:
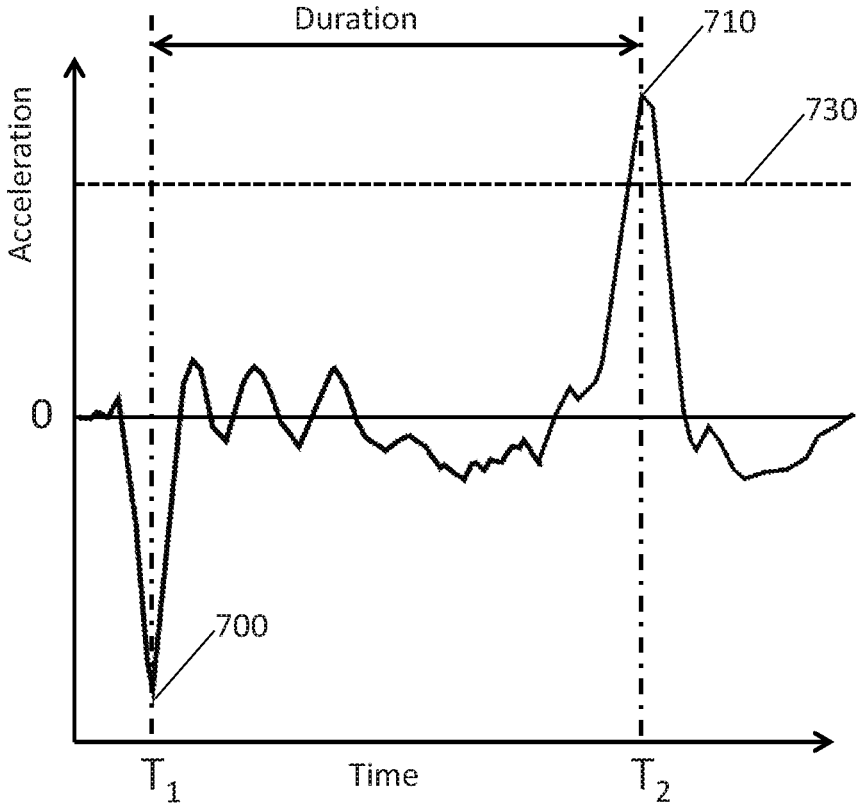
FIG. 7A illustrates a plot of acceleration of a sensor with respect to time.

FIG. 7A illustrates a plot of acceleration of the sensor 280 (shown in FIG. 2) with respect to time. The sensor 280 can include an accelerometer, and the sensor 280 can be coupled to one or more of the moveable components 210 (e.g., the moving bracket 150, a component of a counterbalance mechanism, or the like). Translation of the moveable components 210 (shown in FIG. 2) can be detected by the sensor 280, and the control circuit 180 (shown in FIG. 1) can determine the change in location of the moveable components 210, for instance by using measured acceleration of the moveable components 210. For example, the height of the work surface 110 (shown in FIG. 1) can be varied, for instance by operating the switch 300 (shown in FIG. 3). Varying the height of the work surface 110 can apply forces (e.g., an acceleration force) to the moveable components 210 (e.g., the work surface 110). The forces incident upon the work surface 110 can be measured, for instance by the sensor 280.

FIG. 7A shows a first inflection point 700 (e.g., local minima) that can correspond to the beginning (e.g., at $T_1$) of translation of one or more of the moveable components 210 (e.g., height-adjustment of the work surface 110), for instance when a user operates the switch 300. A second inflection point 710 (e.g., local maxima) can correspond to the end (e.g., at $T_2$) of the translation of the moveable components 210, for example when a user stops operating the switch 300. Acceleration of the moveable components 210 can vary during adjustment of the location (e.g., height) of the work surface 110, for instance between the inflection points 700, 710.

Figure 7B:
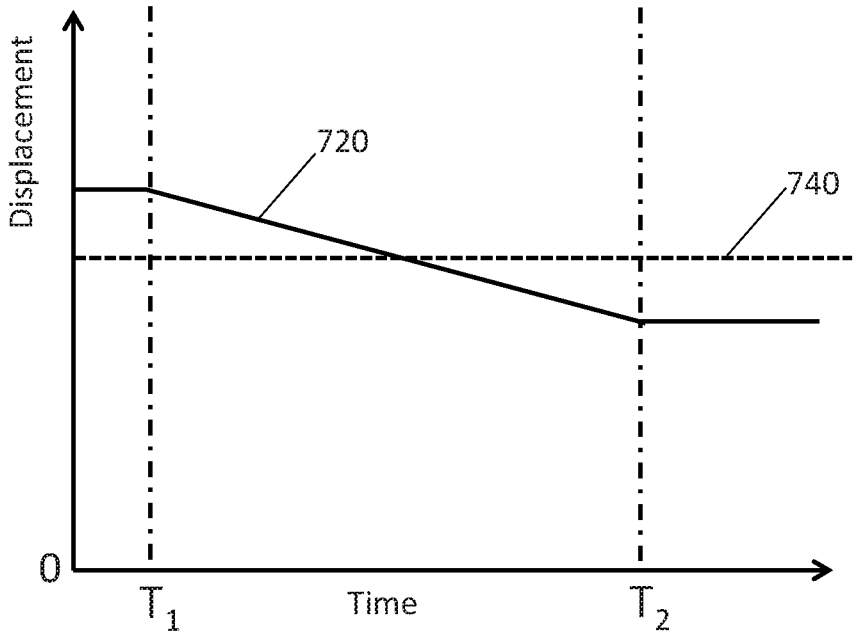
FIG. 7B illustrates a plot of displacement of a sensor with respect to time.

FIG. 7B illustrates a plot of a representation 720 of the work surface displacement. The work surface displacement representation 720 can be determined by the control circuit 180 (shown in FIG. 1). As described herein, the control circuit 180 can determine the representation 720 of the work surface displacement, for instance based on the measured translation of the moveable component 210 relative to the reference point 290. In an example, the control circuit 180 can determine the representation 720 with the measured acceleration and the amount of time that the measured acceleration is incident upon the moveable components 210. For example, the control circuit 180 can determine the representation 720 by integrating the measured acceleration of the work surface 110 (e.g., the area under the plot shown in FIG. 7A). In another example, the control circuit 180 can determine the representation 720 by combining (e.g., multiplying) the average velocity of the moveable components 210 with the time duration that the moveable components 210 were translated (e.g., $T_2$-$T_1$). The control circuit 180 can store the work surface displacement representation 720, for instance in random access memory.

In some examples, the control circuit 180 compares the measured translation (e.g., a value corresponding to the amount of acceleration incident upon the work surface 110) of one or more of the moveable components 210 to a translation threshold 730. The control circuit 180 can generate one or more control signals based on the comparison of the measured translation of the moveable components 210 to the threshold 730. For example, the control circuit 180 can generate a control signal (e.g., that corresponds to the representation 720) when the measured translation exceeds the threshold 730.

The control circuit 180 can compare the work surface displacement representation 720 to a displacement threshold 740. The control circuit 180 can generate a control signal (e.g., a change in voltage, current, impedance, or the like) based on the comparison. For instance, the control circuit 180 can generate the control signal when the work surface displacement representation 720 exceeds the threshold 740. Accordingly, minor displacement of the moveable components 210 (e.g., by a user resting an elbow on the work surface 110) can be filtered to allow the control circuit 180 to determine when a substantial displacement of the moveable components 210 has occurred.

For example, the control circuit 180 can store a cycle count that corresponds to a number of occurrences of the control circuit 180 generating a control signal. The control circuit 710 can increment the cycle count when the control signal is generated. For example, the cycle count can correspond to the number of times that the work surface 110 (shown in FIG. 1) is translated (e.g., raised or lowered) with respect to the frame 140. For instance, the cycle count can be incremented if the work surface 110 is translated more than an inch, more than 80% of a range of motion for the work surface 110, or the like. The cycle count can be incremented based on one or more of the comparisons made by the control circuit 180 (e.g., one or more of the measured translation compared to the threshold 730 and the representation 720 compared to the threshold 740). For example, the cycle count can be incremented when the measured translation exceeds threshold 730 and the representation 720 exceeds the threshold 740.

The control circuit 180 can operate the display 400. For example, the control signal generated by the control circuit 180 can cause the display 400 to present operating instructions related to the operation of the workstation 100. The display 400 can display a safety notification, for instance to notify the user of proper use of the workstation 100. The display 400 can display a maintenance notification that recommends that the user perform one or more maintenance tasks upon the workstation 100. One or more of safety notification, operating instructions, and maintenance notifications can depend at least partially on the cycle count and the position of the work surface (e.g., height of the work surface 110 relative to the frame 120).

In some examples, the control circuit 180 can be included in (or be a component of) a cloud-based system (e.g., a server, or the like) and the control circuit 180 can determine the work surface displacement representation 720 remote from the workstation 110. For example, the control circuit 180 can be in communication with a server, and the server can receive the measured translation of the moveable components 210 and the server can communicate with the control circuit 180 to generate one or more control signals (e.g., to increment a cycle count, to present a notification, or the like).

Figure 8:
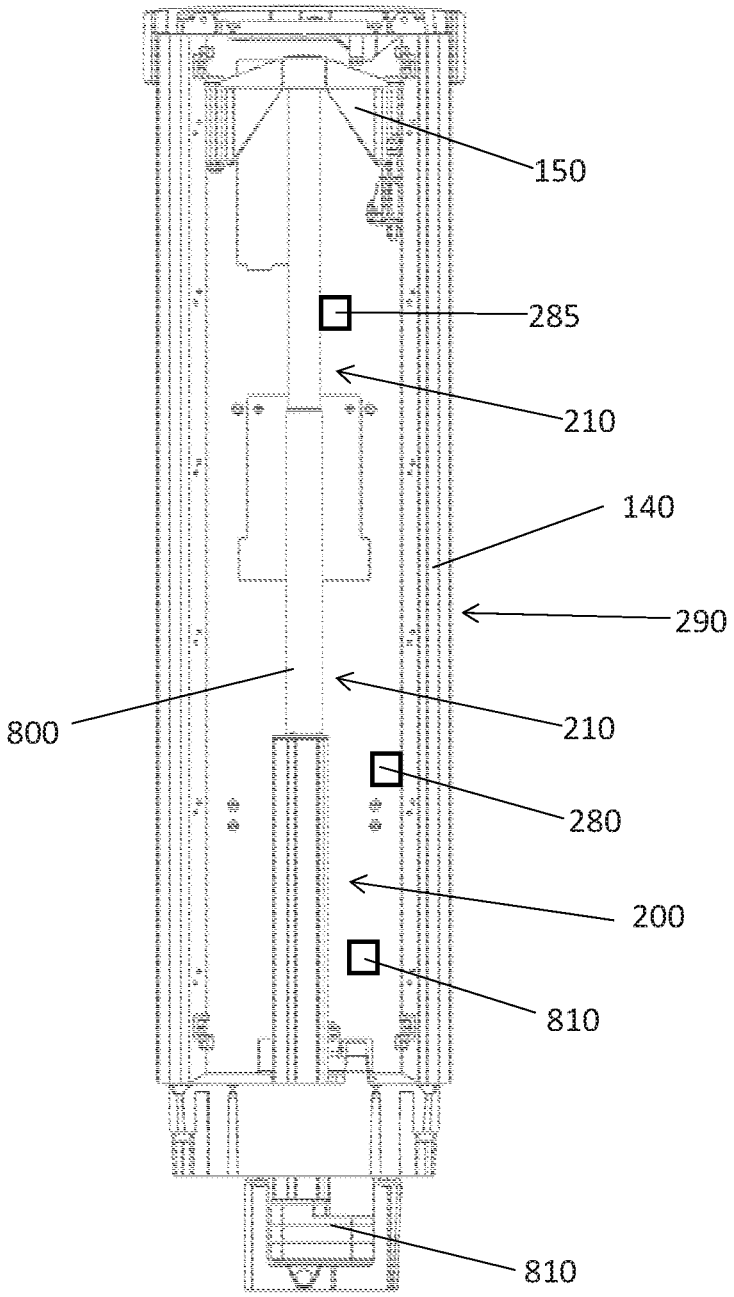
FIG. 8 illustrates a rear view of a lift mechanism, according to an example configuration of the present subject matter.

FIG. 8 illustrates a rear view of the lift mechanism 200, according to an example configuration of the present subject matter. The lift mechanism 200 can include a telescoping member 800 and a motor 810. The motor 810 can adjust the height (e.g., overall dimension) of the telescoping member 800. For example, the motor 810 can cause the telescoping member 800 to translate (e.g., expand or contract). Accordingly, the telescoping member 800 and the motor 810 can be included in the moveable components 210. The telescoping member 800 can be coupled to the moving bracket 150, and the translation of the telescoping member 800 can correspondingly translate the moving bracket 150 relative to the frame 140. The sensor operator 285 can be coupled to the telescoping member 800, and the sensor 280 can be coupled to the reference point 290, such as the frame 140. The sensor can measure the change in location of the moveable components 210 with respect to the reference point 290.

In some examples, position feedback from the actuator 500 can be used to determine the range of motion. For example, position feedback can be obtained from the actuator 500 with a potentiometer, an encoder using optical sensors, an encoder using hall effect sensors, or the like. For instance, a hall effect encoder 810 can have one or more magnets (e.g., the sensor operator 285) on a portion of the telescoping member 800 (e.g., a shaft of the actuator 500), and the encoder 810 can have one or more hall effect sensors (e.g., the sensor 280) near the magnets. The hall effect sensors measure the strength of a nearby magnetic field, for instance to detect the orientation of the motor shaft. The encoder 810 can be in communication with the control circuit 180. The encoder 810 can transfer information (e.g., detected strength of a magnetic field) to the control circuit 180 (e.g., a square wave data set), and the information can be analyzed (e.g., by counting a string of pulses in the data set). Analyzing the information can monitor how many times the actuator 500 has been operated, and can monitor the amount of displacement of the telescoping member 800.

In an example, one or more hall effect sensors can be used, for example two sensors (e.g., sensor A and sensor B). The sensors can be installed at a 90 degree offset (e.g., with respect to the telescoping member 800). The hall effect sensors can monitor the change in magnetic field, and can help determine which way the actuator 500 is moving. For example, the sensors can help determine which way a shaft is spinning, for instance if sensor A measures a change in magnetic field before sensor B measures the change.

The control circuit 180 (shown in FIG. 1) can determine when a cycle of the workstation 100 is reached, and can increment the cycle count. In some example configurations, the control circuit 180 can determine the total height adjustment by adding subsequent height adjustments, for instance when they are in the same direction. When the total height adjustment reaches a predetermined value (e.g., 80% of the maximum height adjustment, or when the threshold 710 is met), the control circuit 180 can increment the cycle count by one. Both height adjustment and the cycle count can be recorded in memory.

As described herein, the sensor 280 can include a potentiometer, including (but not limited to) a rotational potentiometer, a slider-type (e.g., linear) potentiometer, or the like. In an example, a slider-type potentiometer can be coupled to moveable components 210, for instance the telescoping member 800. Translation (e.g., extension, contraction, or the like) of the telescoping member 800 can vary a voltage output of the potentiometer in proportion to the translation of the telescoping member. The voltage output of the potentiometer can be monitored or recorded by the control circuit 180, and the control circuit 180 can determine the work surface displacement representation 720 based on the measured translation by the slide-type potentiometer.

Referring again to FIG. 2, the sensor 280 can include a rotational potentiometer can be coupled to the moveable components 210, for instance the wheel assembly 240. Rotation of the wheel assembly 240 can vary the voltage output by the potentiometer, and the voltage output by the potentiometer can be monitored or recorded by the control circuit 180. The control circuit 180 can determine the work surface displacement representation 720 based on the measured translation by the rotational potentiometer.

Figure 9:
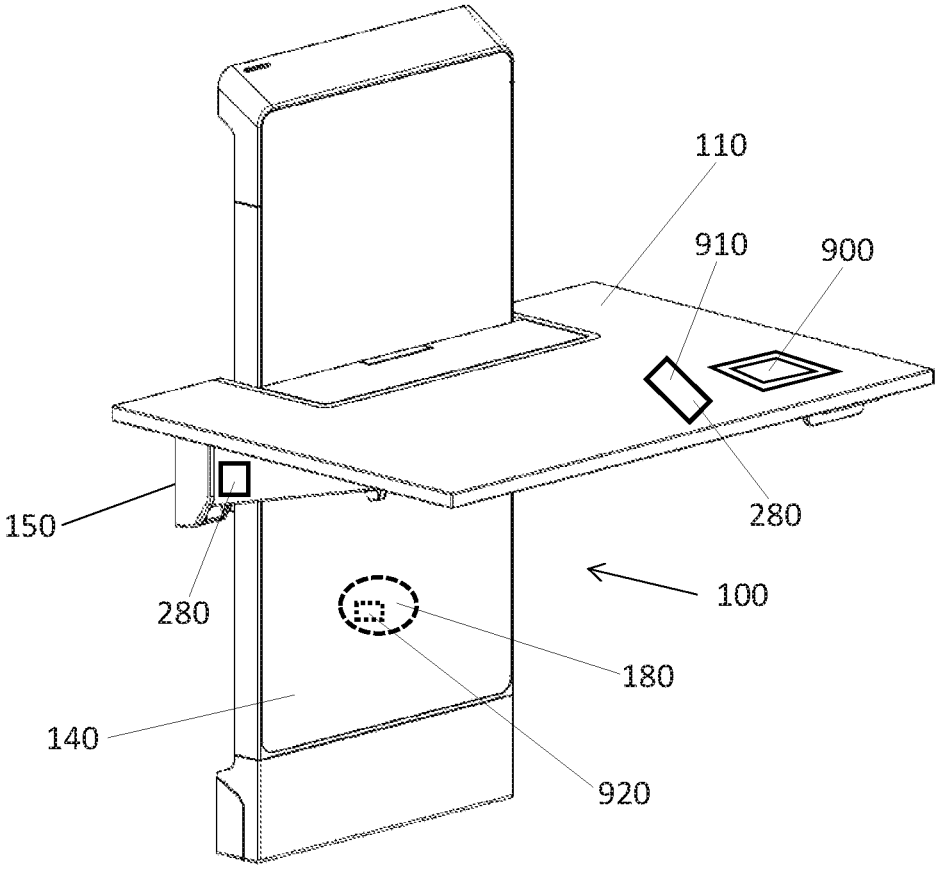
FIG. 9 illustrates a perspective view of still yet another example of the workstation, according to an example configuration of the present subject matter.

FIG. 9 illustrates a perspective view of still yet another example of the workstation 100, according to an example configuration of the present subject matter. In some examples, the sensor 280 can be coupled to the moveable bracket 150, and the sensor 280 can detect a change in location of the moveable bracket 150. For example, the moveable bracket 150 can translate relative to the frame 140 to raise and lower the work surface 110. In an example, the workstation 100 can include an electronic device charger 900 (e.g., a Qi charger, inductive charger, USB port, or the like), for instance on the work surface 110. The electronic device charger 900 can charge a personal electronic device 910 (e.g., a cell phone, tablet, laptop, or the like).

The personal electronic device 910 can be in communication with the control circuit 180. For example, the control circuit 180 can include a network interface 920, and the electronic device 910 can communicate with the control circuit 180 through the network interface 920 (e.g., with a wired or wireless electronic communication pathway). The electronic device 910 can measure translation of the moveable components 210. Accordingly, the electronic device 910 can be an example of the sensor 280. For instance, the electronic device 910 can include accelerometers, inertia sensors, or the like. The electronic device 910 can be located on the work surface 110, and the electronic device 910 can measure translation of the work surface 110. The electronic device 910 can provide the measured translation of the moveable components 210 to the control circuit 180 through the network interface 920, and the control circuit 180 can determine the work surface displacement representation 720 (shown in FIG. 7) based on measured translation provided by the electronic device 910. In some examples the sensor 280 is not an integral part of (e.g., directly coupled to) the workstation 100, for instance because the personal electronic device 100 measures the translation of the moveable components 210.

Figure 10:
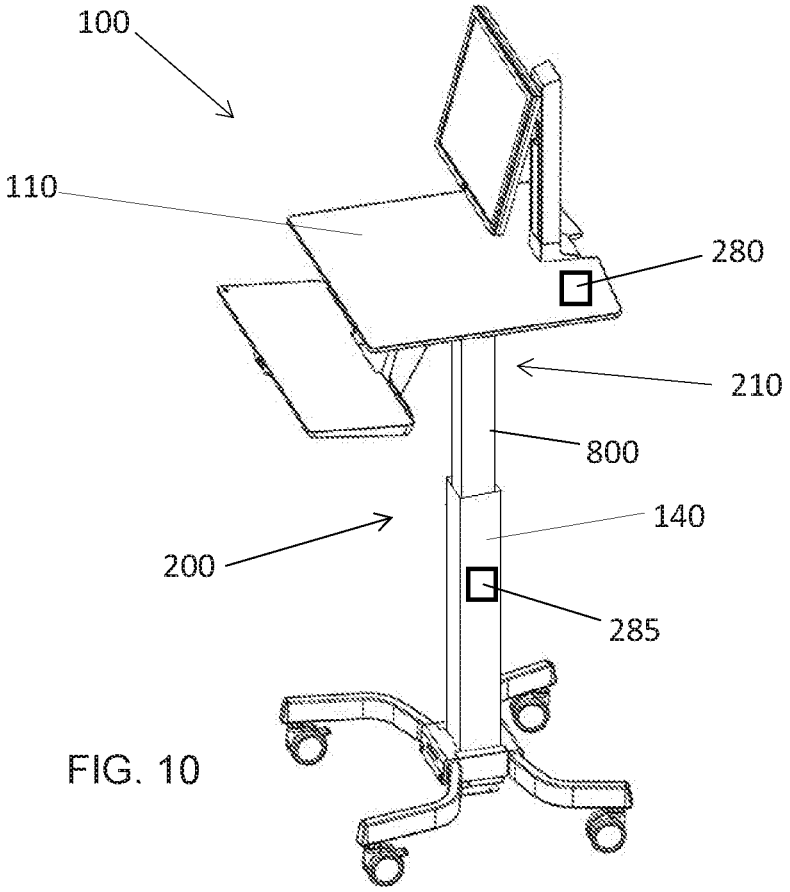
FIG. 10 illustrates an additional example of the workstation, according to an example configuration of the present subject matter.

FIG. 10 illustrates an additional example of the workstation 100, according to an example configuration of the present subject matter. As described herein, in some examples the lift assembly 200 includes the telescoping member 800, and the telescoping member 800 can be included in the moveable components 210. The sensor 280 can be coupled to the work surface 110, and the sensor operator 285 can be coupled to the frame 140. The sensor 280 can detect the translation of the work surface 110 relative to the frame 140.

Figure 11:
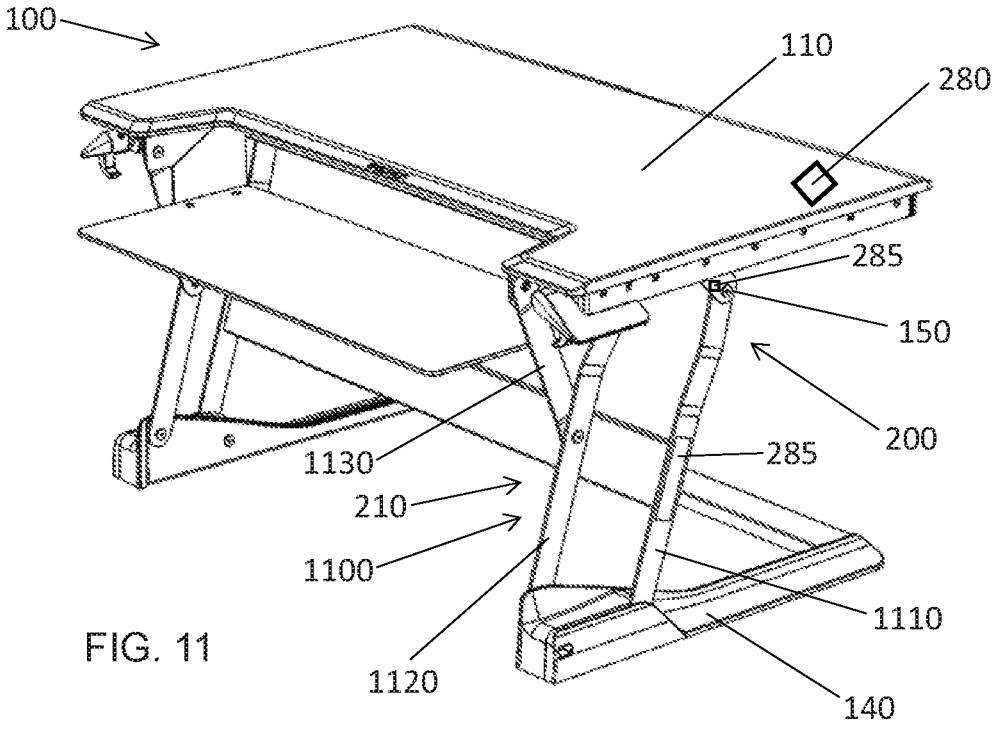
FIG. 11 illustrates a further example of the workstation, according to an example configuration of the present subject matter.

FIG. 11 illustrates a further example of the workstation 100, according to an example configuration of the present subject matter. In some examples, the workstation 100 includes a linkage assembly 1100, and the linkage assembly 1100 can be included in the lift assembly 200. The linkage assembly 1100 can include a first linkage 1110, a second linkage 1120, and can include a third linkage 1130. The linkage assembly 1100 (e.g., the linkage 1110) can be coupled to the moving bracket 150. The linkage 1110 can translate relative to the frame 140, for instance when the work surface 110 is translated relative to the frame 140. Accordingly, the linkage assembly 1100 can be included in the moveable components 210. The sensor 280 can be coupled to the work surface 110, and the sensor operator 285 can be coupled to the linkage assembly 1100. For instance, the sensor operator 285 can be coupled to the first linkage 1110 or can be coupled to the moving bracket 150. The sensor 280 detect the translation of the work surface 110 relative to the frame 140.

In an example, the workstation 100 can be similar to (and can incorporate components of) the height adjustable platform described in U.S. patent application Ser. No. 15/892,167 entitled "HEIGHT ADJUSTABLE DESKTOP WORK SURFACE," filed on Feb. 8, 2018, which is hereby incorporated by reference herein in its entirety. For instance, the workstation 100 (e.g., the lift assembly 200) can include an adjustment assembly, a support bracket, a glide assembly, linkages, or the like.

Figure 12:
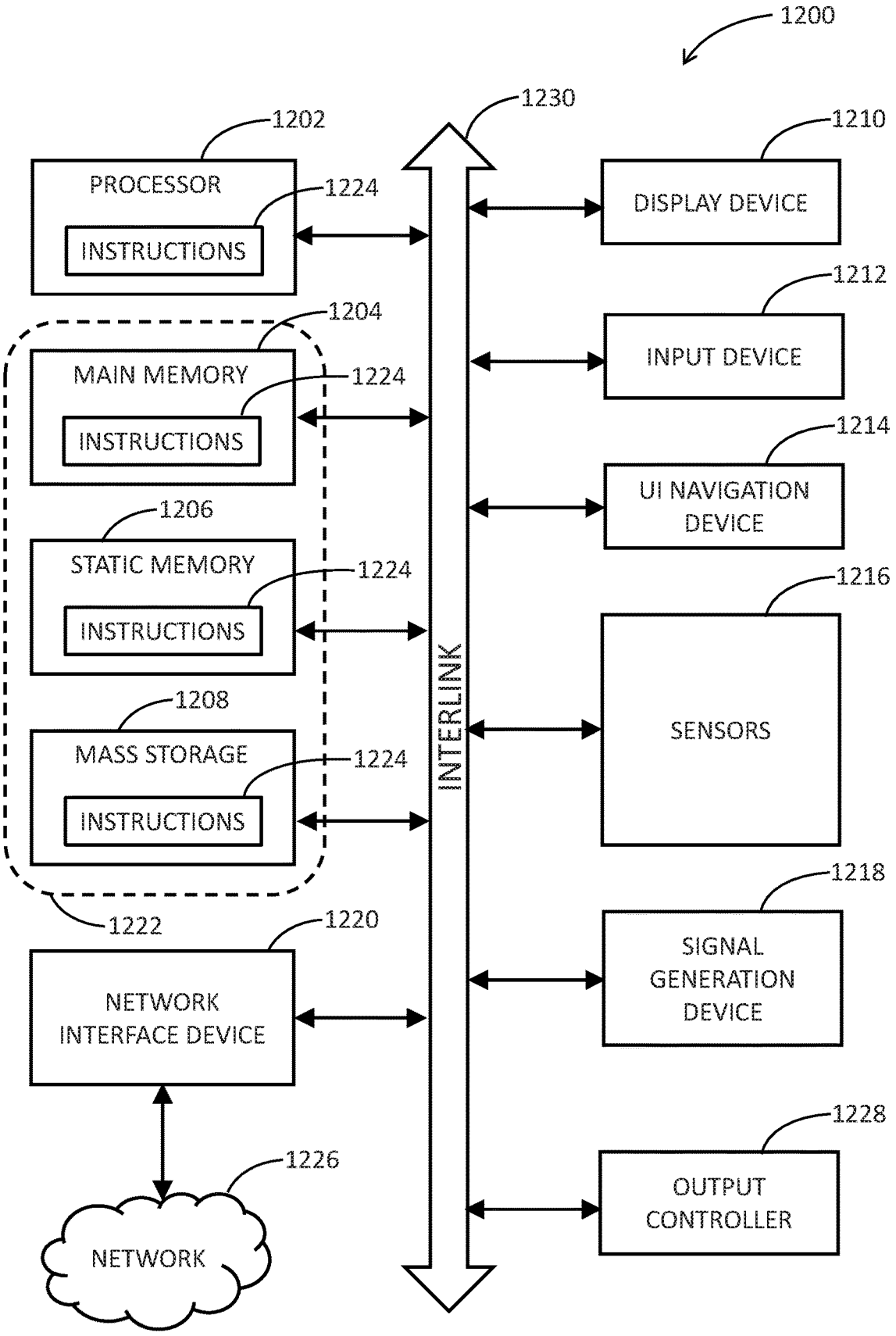
FIG. 12 illustrates a block diagram of an example machine upon which any one or more of the techniques discussed herein may perform.

FIG. 12 illustrates a block diagram of an example machine 1200 upon which any one or more of the techniques (e.g., methodologies) discussed herein may perform. Examples, as described herein, may include, or may operate by, logic or a number of components, or mechanisms in the machine 1200. Circuitry (e.g., processing circuitry) is a collection of circuits implemented in tangible entities of the machine 1200 that include hardware (e.g., simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine-readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 1200 follow.

In alternative configurations, the machine 1200 may operate as a standalone device or may be connected (e.g., networked) to other machines. In a networked deployment, the machine 1200 may operate in the capacity of a server machine, a client machine, or both in server-client network environments. In an example, the machine 1200 may act as a peer machine in peer-to-peer (P2P) (or other distributed) network environment. The machine 1200 may be a personal computer (PC), a tablet PC, a set-top box (STB), a personal digital assistant (PDA), a mobile telephone, a web appliance, a network router, switch or bridge, or any machine capable of executing instructions (sequential or otherwise)

that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 1200 may include a hardware processor 1202 (e.g., a central processing unit (CPU), a graphics processing unit (GPU), a hardware processor core, or any combination thereof), a main memory 1204, a static memory (e.g., memory or storage for firmware, microcode, a basic-input-output (BIOS), unified extensible firmware interface (UEFI), etc.) 1206, and mass storage 1208 (e.g., hard drive, tape drive, flash storage, or other block devices) some or all of which may communicate with each other via an interlink (e.g., bus) 1230. The machine 1200 may further include a display unit 1210, an alphanumeric input device 1212 (e.g., a keyboard), and a user interface (UI) navigation device 1214 (e.g., a mouse). In an example, the display unit 1210, input device 1212 and UI navigation device 1214 may be a touch screen display. The machine 1200 may additionally include a storage device (e.g., drive unit) 1208, a signal generation device 1218 (e.g., a speaker), a network interface device 1220, and one or more sensors 1216, such as a global positioning system (GPS) sensor, compass, accelerometer, or other sensor. The machine 1200 may include an output controller 1228, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 1202, the main memory 1204, the static memory 1206, or the mass storage 1208 may be, or include, a machine readable medium 1222 on which is stored one or more sets of data structures or instructions 1224 (e.g., software) embodying or utilized by any one or more of the techniques or functions described herein. The instructions 1224 may also reside, completely or at least partially, within any of registers of the processor 1202, the main memory 1204, the static memory 1206, or the mass storage 1208 during execution thereof by the machine 1200. In an example, one or any combination of the hardware processor 1202, the main memory 1204, the static memory 1206, or the mass storage 1208 may constitute the machine readable media 1222. While the machine readable medium 1222 is illustrated as a single medium, the term "machine-readable medium" may include a single medium or multiple media (e.g., a centralized or distributed database, and/or associated caches and servers) configured to store the one or more instructions 1224.

The term "machine readable medium" may include any medium that is capable of storing, encoding, or carrying instructions for execution by the machine 1200 and that cause the machine 1200 to perform any one or more of the techniques of the present disclosure, or that is capable of storing, encoding or carrying data structures used by or associated with such instructions. Non-limiting machine-readable medium examples may include solid-state memories, optical media, magnetic media, and signals (e.g., radio frequency signals, other photon-based signals, sound signals, etc.). In an example, a non-transitory machine-readable medium comprises a machine-readable medium with one or more particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1224 may be further transmitted or received over a communications network 1226 using a transmission medium via the network interface device 1220 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 1220 may include one or more physical jacks (e.g., Ethernet, coaxial, or phone jacks) or one or more antennas to connect to the communications network 1226. In an example, the network interface device 1220 may include one or more antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 1200, and includes digital or analog communications signals or other intangible medium to facilitate communication of such software. A transmission medium is a machine readable medium.

Additional Notes and Aspects

Aspect 1 may include or use subject matter (such as an apparatus, a system, a device, a method, a means for performing acts, or a device readable medium including instructions that, when performed by the device, may cause the device to perform acts), such as may include or use a workstation including a height-adjustable work surface, the workstation comprising: a frame, wherein the work surface is configured to translate relative to the frame to vary a height of the work surface; a lift assembly configured to assist translation of the work surface relative to the frame, wherein the lift assembly includes a moveable component and translation of the moveable component relative to a reference point results in a corresponding translation of the work surface relative to the frame; a translation sensor configured to measure translation of the moveable component relative to the reference point; a control circuit in communication with the translation sensor and configured to determine a representation of a work surface displacement based on the measured translation of the moveable component relative to the reference point, wherein the representation of the work surface displacement corresponds to an amount of translation of the work surface relative to the frame.

Aspect 2 may include or use, or may optionally be combined with the subject matter of Aspect 1, to optionally include or use wherein the control circuit is further configured to: store the work surface displacement representation; compare the work surface displacement representation to a threshold; generate a first control signal based on the comparison of the work surface displacement representation to the threshold.

Aspect 3 may include or use, or may optionally be combined with the subject matter of Aspect 2, to optionally include or use wherein the control circuit is further configured to: store a cycle count that corresponds to a number of occurrences of the control circuit generating the first control signal; and increment the cycle count value based on the generated first control signal.

Aspect 4 may include or use, or may optionally be combined with the subject matter of Aspect 3, to optionally include or use wherein the first control signal causes a display to present operating instructions to a user of the workstation.

Aspect 5 may include or use, or may optionally be combined with the subject matter of Aspect 4, to optionally include or use wherein the operating instructions include a safety notification.

Aspect 6 may include or use, or may optionally be combined with the subject matter of Aspect 3, to optionally include or use wherein the control circuit is further configured to generate usage statistics based on the work surface displacement value.

Aspect 7 may include or use, or may optionally be combined with the subject matter of Aspect 6, to optionally include or use wherein the usage statistics include one or more of a height of the work surface, an amount of change in the height of the work surface, a time duration that the work surface is positioned at a specified height, and the cycle count value.

Aspect 8 may include or use, or may optionally be combined with the subject matter of Aspect 3, to optionally include or use wherein the control circuit is further configured to compare the cycle count to a cycle threshold, and generate a second control signal based on the comparison.

Aspect 9 may include or use, or may optionally be combined with the subject matter of Aspect 2, to optionally include or use wherein the first control signal causes a display to present operating instructions to a user of the workstation.

Aspect 10 may include or use, or may optionally be combined with the subject matter of Aspect 1, to optionally include or use wherein the reference point includes one or more of a fixed component of the lift assembly and the frame.

Aspect 11 may include or use, or may optionally be combined with the subject matter of Aspect 1, to optionally include or use wherein the translation sensor includes one or more of an optical sensor, a potentiometer, an accelerometer, a hall effect sensor, and a transducer.

Aspect 12 may include or use, or may optionally be combined with the subject matter of Aspect 1, to optionally include or use wherein the lift assembly includes one or more of a linear actuator, a spring, a cable and a pulley, and a linkage assembly.

Aspect 13 may include or use, or may optionally be combined with the subject matter of Aspect 12, to optionally include or use a sensor operator, wherein the sensor operator is coupled to the spring.

Aspect 14 may include or use, or may optionally be combined with the subject matter of Aspect 12, to optionally include or use wherein the linkage assembly further includes a first linkage, a second linkage, and a third linkage.

Aspect 15 may include or use, or may optionally be combined with the subject matter of Aspect 14, to optionally include or use a sensor operator, wherein the sensor operator is coupled to one of the first linkage, the second linkage, and the third linkage.

Each of these non-limiting examples can stand on its own, or can be combined in any permutation or combination with any one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A workstation including a height-adjustable work surface, the workstation comprising:

a frame, wherein the work surface is configured to translate relative to the frame to vary a height of the work surface;

a lift assembly configured to assist translation of the work surface relative to the frame, wherein the lift assembly includes a moveable component and translation of the moveable component relative to a reference point results in a corresponding translation of the work surface relative to the frame;

a translation sensor configured to measure translation of the moveable component relative to the reference point; and a control circuit in communication with the translation sensor and configured to determine a representation of a work surface displacement based on the measured translation of the moveable component relative to the reference point, wherein the representation of the work surface displacement corresponds to an amount of translation of the work surface relative to the frame, and wherein:

the control circuit is configured to store the work surface displacement representation;

the control circuit is configured to compare the work surface displacement representation to a threshold;

the control circuit is configured to generate a first control signal based on the comparison of the work surface displacement representation to the threshold;

the control circuit is configured to store a cycle count that corresponds to a number of occurrences of the control circuit generating the first control signal; and the control circuit is configured to increment the cycle count based on the generated first control signal.

2. The workstation of claim 1, wherein the control circuit is further configured to generate usage statistics based on the work surface displacement representation.

3. The workstation of claim 2, wherein the usage statistics include one or more of a height of the work surface, an amount of change in the height of the work surface, a time duration that the work surface is positioned at a specified height, and the cycle count value.

4. The workstation of claim 1, wherein the control circuit is further configured to compare the cycle count value to a cycle threshold, and generate a second control signal based on the comparison.

5. The workstation of claim 1, wherein the first control signal causes a display to present operating instructions to a user of the workstation.

6. The workstation of claim 1, wherein the reference point includes one or more of a fixed component of the lift assembly and the frame.

7. The workstation of claim 1, wherein the translation sensor includes one or more of an optical sensor, a potentiometer, an accelerometer, a hall effect sensor, and a transducer.

8. The workstation of claim 1, wherein the lift assembly includes one or more of a linear actuator, a spring, a cable and a pulley, and a linkage assembly.

9. The workstation of claim 8, further including a sensor operator, wherein the sensor operator is coupled to the spring.

10. The workstation of claim 8, wherein the linkage assembly further includes a first linkage, a second linkage, and a third linkage.

11. The workstation of claim 8, further including a sensor operator, wherein the sensor operator is coupled to one of the first linkage, the second linkage, and the third linkage.

* * * * *